US005981431A

United States Patent [19]

Lawrence et al.

[11] Patent Number: 5,981,431

[45] Date of Patent: Nov. 9, 1999

[54] THERMAL DYE TRANSFER RECEIVING ELEMENT

[75] Inventors: Kristine B. Lawrence, Rochester, N.Y.; Wayne A. Bowman, Medina, Ohio; Teh-Ming Kung, Rochester, N.Y.

[73] Assignee: Eastman Kodak Company, Rochester, N.Y.

[21] Appl. No.: 09/059,881

[22] Filed: Apr. 14, 1998

[51] Int. Cl.[6] ..... B41M 5/035; B41M 5/38

[52] U.S. Cl. ..... 503/227; 428/195; 428/421; 428/480; 428/500; 428/913; 428/914

[58] Field of Search ..... 8/471; 428/195, 428/421, 480, 500, 913, 914; 502/227

[56] References Cited

U.S. PATENT DOCUMENTS 5,250,494 10/1993 Wehrmann et al. ..... 503/227
5,317,001 5/1994 Daly et al. ..... 503/227

FOREIGN PATENT DOCUMENTS 2-258389 10/1990 Japan .
4-074693 3/1992 Japan .

*Primary Examiner*—Bruce Hess
*Attorney, Agent, or Firm*—Harold E. Cole

[57] ABSTRACT

A dye-receiving element for thermal dye transfer comprising a support having on one side thereof a dye image-receiving layer comprising a water-dispersible polyester having the following structure:

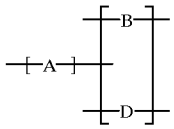

wherein:

A is the residue of one or more diol components;

B is the residue of a diacid component; and

D is the residue of another diacid component;

the dye image-receiving layer having an overcoat layer comprising a fluorine-containing acrylate polymer.

15 Claims, No Drawings

THERMAL DYE TRANSFER RECEIVING ELEMENT

FIELD OF THE INVENTION

This invention relates to dye-receiving elements used in thermal dye transfer, and more particularly to polyester dye image-receiving layers for such elements.

BACKGROUND OF THE INVENTION

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dye receiving elements used in thermal dye transfer generally include a support (transparent or reflective) bearing on one side thereof a dye image-receiving layer, and optionally additional layers. The dye-receiving layer comprises a polymeric material chosen from a wide assortment of compositions and should have good affinity for the dye. Dyes must migrate rapidly into the layer during the transfer step and become immobile and stable in the viewing environment. One way to immobilize the dye in the receiving element is to transfer a laminate layer from the donor element to the receiver after the image has been generated. The dye-receiving layer must also not stick to the hot donor during the printing process, otherwise the final image will be damaged due to either the donor or receiver tearing while peeling apart after the printing step. One way to prevent donor-receiver sticking is to apply an overcoat layer or to add release agents to the receiver layer. The overcoat would require a separate coating step which increases manufacturing costs of the dye-receiving element and addition of release agents increases the media costs.

DESCRIPTION OF RELATED ART

U.S. Pat. No. 5,317,001 relates to thermal dye transfer to a receiver element. The dye-receiving layer is described as comprising a water-dispersible polyester. These materials are aqueous coatable and were found to provide good image-receiving layer polymers because of their effective dye-compatibility and receptivity. However, there is a problem with this material in that severe donor-receiver sticking occurs during the printing process.

U.S. Pat. No. 5,250,494 relates to a dye-receiver element for thermal sublimation printing. The dye-receiving layer is described as being a polyester formed from diols which contain long-chained fatty acid-derived materials and dicarboxylic acids. However, there is a problem with these materials in that they are not water-dispersible and have to be coated from a solvent which has environmental problems.

JP Kokai 4-074693 relates to the use of a dye-receiving layer for sublimation type thermal transfer containing a block polymer with a fluoroalkyl acrylate as one of the components to improve release properties between the dye-receiving layer and the dye-donor layer. However, these materials were used in the dye-receiving layer only and not in an overcoat layer.

JP Kokai 2-258389 relates to the use of a dye-fixing material for thermal transfer recording. The image receiving layer contains a fluorine-containing compound in the outermost layer and a polyester in the dye-receiving layer. Types of fluorine-containing materials that were used include fluorine based oils, fine particles of ethylene tetrafluoride resin or ethylene tetrafluoride/propylene hexafluoride copolymer. However, there is a problem with using these materials in a receiving element in that it had very poor uptake of the dye, as will be shown hereinafter.

It is an object of this invention to provide a receiver element for thermal dye transfer processes with a dye image-receiving layer that is water-coatable. It is another object of the invention to provide a receiver element for thermal dye transfer processes which will not stick to the donor during the printing process. It is another object of the invention to provide a receiver element for the thermal dye transfer process that will give good uptake of the dye.

SUMMARY OF THE INVENTION

These and other objects are achieved in accordance with this invention which comprises a dye-receiving element for thermal dye transfer comprising a support having on one side thereof a dye image-receiving layer comprising a water-dispersible polyester having the following structure:

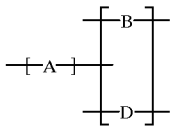

wherein:

A is the residue of one or more diol components which together comprise 100 mole % of recurring units and is represented by the following structure:

$$—O—(CHR^2CHR^3O)_m—R^1—(OCHR^2CHR^3)_n—O—$$

wherein:

$R^1$ represents S, an alkylene group of 1 to about 16 carbon atoms; a cycloalkylene group of 5 to about 20 carbon atoms; a cyclobisalkylene group of about 8 to about 20 carbon atoms, a bi- or tri-cycloalkylene group of about 7 to about 16 carbon atoms, a bi- or tri-cyclobisalkylene group of about 9 to about 18 carbon atoms, an arenebisalkylene group of from 8 to about 20 carbon atoms or an arylene group of 6 to about 12 carbon atoms;

$R^2$ and $R^3$ each independently represents H, a substituted or unsubstituted alkyl group of about 1 to about 6 carbon atoms or a substituted or unsubstituted aryl group of about 6 to about 12 carbon atoms; and m and n each independently represents an integer from 0–4;

B is the residue of a diacid component which comprises about 8 to 50 mole % of recurring units and is represented by one or more of the following structures:

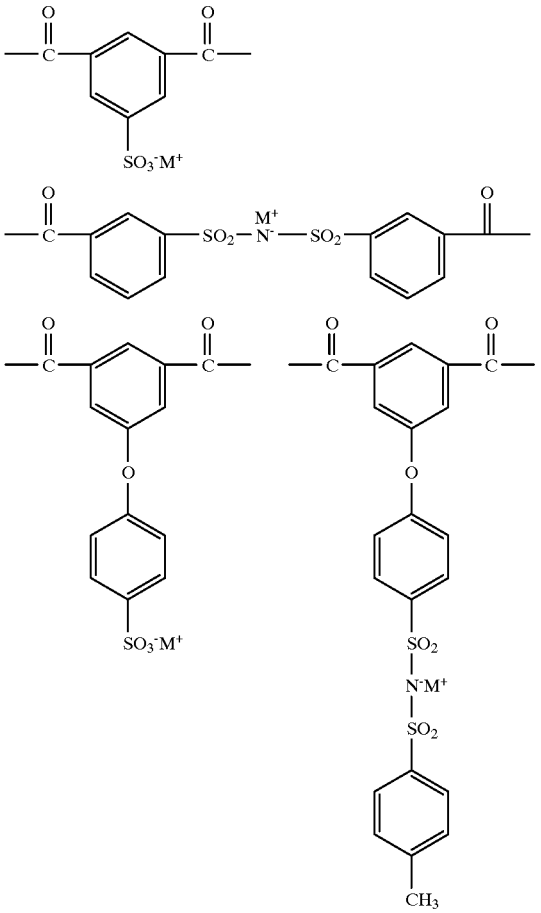

wherein $M^+$ represents either the sodium salt or the sulfonic acid or the protonated form of a basic, nitrogen containing moiety having a pKa measured in water of from about 6 to about 10; and D is the residue of a diacid component which comprises 50 to 92 mole % of recurring units and is represented by one or more of the following structures:

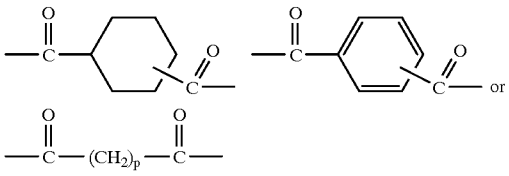

where p represents an integer from 2 to 10;

the dye image-receiving layer having an overcoat layer comprising a fluorine-containing acrylate polymer.

DESCRIPTION OF THE PREFERRED EMBODIMENTS

The polyester employed in the invention preferably has a Tg between about −50° C. and 100° C. Higher Tg polyesters may be used if a plasticizer is added. In a preferred embodiment of the invention, the polyester has a number average molecular weight of from about 10,000 to about 250,000, more preferably from 20,000 to 100,000.

Examples of polyesters used in the invention include the following:

P-1: poly[cis/trans-1,4-cyclohexanedicarboxylic acid-co-5-sulfoisophthalic acid, sodium salt (84:16 molar ratio)-trans 1,4-cyclohexanedimethanol (100 molar ratio)], Mw=25,700, Tg=54° C.

P-2 poly[cis/trans-1,4-cyclohexanedicarboxylic acid-co-5-sulfoisophthalic acid, sodium salt (84:16 molar ratio)-trans 1,4-cyclohexanedimethanol-co-tripropylene glycol (92:8 molar ratio)], Mw=28,600, Tg=62° C.

P-3 poly[cis/trans-1,4-cyclohexanedicarboxylic acid-co-5-sulfoisophthalic acid, sodium salt (84:16 molar ratio)-trans 1,4-cyclohexanedimethanol-co-octane diol (76:24 molar ratio)], Mw=45,500, Tg=20° C.

P-4 poly[cis/trans-1,4-cyclohexanedicarboxylic acid-co-5-sulfoisophthalic acid, sodium salt (84:16 molar ratio)-trans 1,4-cyclohexanedimethanol-co-decane diol (94:6 molar ratio)], Mw=11,900, Tg=49° C.

P-5 poly[isophthalic acid-co-5-sulfoisophthalic acid (90:10 molar ratio)-diethylene glycol (100 molar ratio)], Mw=20,000(sulfonic acid of AQ29D®, Eastman Chemical Co.), Tg=28° C.

The synthesis of the aqueous dispersible polyesters is analogous to the procedure described in U.S. Pat. No. 5,317,001, the disclosure of which is hereby incorporated by reference.

The polyester employed in the invention may be used alone or in combination with other polymers having no or slight acidity. These other polymers include condensation polymers such as polyesters, polyurethanes, polycarbonates, etc.; addition polymers such as polystyrenes, vinyl polymers, acrylic polymers, etc.; or block copolymers containing large segments of more than one type of polymer covalently linked together. In a preferred embodiment of the invention, an acrylic polymer, a styrene polymer or a vinyl polymer having a Tg of less than 19° C. is used. These polymers may be employed at a concentration ranging from about 0.5 g/m$^2$ to about 10 g/m$^2$ and may be coated from organic solvents or water, if desired.

Examples of such other polymers include the following:

Polymer A: poly(butyl acrylate-co-allyl methacrylate) 98:2 wt core/poly(glycidyl methacrylate) 10 wt shell, (Tg=−40° C.)

Polymer B: poly(butyl acrylate-co-allyl methacrylate) 98:2 wt core/poly(ethyl methacrylate) 30 wt shell, (Tg=−41° C.)

Polymer C: poly(butyl acrylate-co-allyl methacrylate) 98:2 wt core/poly(2-hydroxypropyl methacrylate,) 10 wt shell, (Tg=−40° C.)

Polymer D: poly(butyl acrylate-co-ethylene glycol dimethacrylate) 98:2 wt core/poly(glycidyl methacrylate 10 wt shell, Tg=−42° C.)

Polymer E: poly(butyl acrylate-co-allyl methacrylate-co-glycidyl methacrylate) 89:2:9 wt, (Tg=−34° C.)

Polymer F: poly(butyl acrylate-co-ethylene glycol dimethacrylate-co-glycidyl methacrylate) 89:2:9 wt (Tg=−28° C.)

Polymer G: poly(butyl methacrylate-co-butyl acrylate-co-allyl methacrylate) 49:49:2 wt core/poly(glycidyl methacrylate) 10 wt shell, (Tg=−18° C.)

Polymer H: poly(methyl methacrylate-co-butyl acrylate-co-2-hydroxyethyl methacrylate-co-2-sulfoethyl methacrylate, sodium salt) 30:50:10:10 wt, (Tg=−3° C.)

Polymer I: poly(methyl methacrylate-co-butyl acrylate-co-2-hydroxyethyl methacrylate-co-styrenesulfonic acid, sodium salt) 40:40:10:10 wt, (Tg=0° C.)

Polymer J: poly(methyl methacrylate-co-butyl acrylate-co-2-sulfoethyl methacrylate, sodium salt-co-ethylene glycol dimethacrylate) 44:44:10:2 wt, (Tg=14° C.)

Polymer K: poly(butyl acrylate-co-Zonyl TM®-co-2-acrylamido-2-methyl-propanesulfonic acid, sodium salt) 50:45:5 wt (Tg=−39° C.) (Zonyl TM® is a monomer from the DuPont Company)

Polymer L: XU31066.50 (experimental polymer based on a styrene butadiene copolymer from Dow Chemical Company) (Tg=−31° C.)

Polymer M: AC540® nonionic emulsion (Allied Signal Co.) (Tg=−55° C.)

The polyester employed in the dye image-receiving layer of the invention may be present in any amount which is effective for its intended purpose. In general, good results have been obtained at a concentration of from about 0.5 to about 10 g/m$^2$.

In a preferred embodiment, the fluorine-containing acrylate polymer used in the overcoat layer of the dye receiving element of the invention is a vinyl ester having the following general formula:

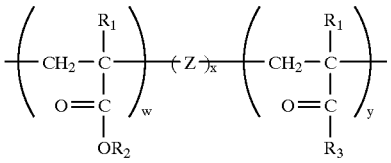

wherein:

$R_1$ is hydrogen or methyl;

$R_2$ is a substituted or unsubstituted alkyl group of 1 to about 16 carbon atoms; a cycloalkylene group of 5 to about 20 carbon atoms; or a substituted or unsubstituted aryl group of 1 to about 6 carbon atoms;

$R_3$ is a water solubilizing monomer such as 2-acrylamidomethylpropanesulfonic acid sodium salt, sulfoethylacrylate sodium salt, sulfopropylacrylate sodium salt, trimethylammoniumethylacrylate chloride salt, or trimethylammoniumethylacrylate methylsulfate salt;

Z is a repeat unit derived from acrylate or methacrylate esters of a fluorinated alcohol $HOCH_2CH_2(CF_2)_n—CF_3$, where n is between 3 and 17, and the alcohol can contain a distribution of chain lengths, such as the following Zonyl® materials (DuPont Chemical Co.):

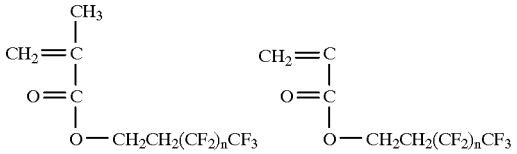

where n is about 3 to about 17 Zonyl TM® Zonyl TA—N®;

w represents a number that yields from 90 to 50 weight percent of the polymer;

x represents a number that yields from 50 to 10 weight percent of the polymer; and y represents a number that yields from 0 to 10 weight percent of the polymer.

Examples of fluorine-containing acrylate polymers that may be used as the overcoat layer in the dye receiving element of the invention include:

I-1: poly(butyl methacrylate-co-Zonyl TM®-co-2-acrylamido-2-methylpropanesulfonic acid, sodium salt) 75:20:5 wt (Tg=34° C.)

I-2: poly(butyl methacrylate-co-Zonyl TM®-co-2-acrylamido-2-methylpropanesulfonic acid, sodium salt) 65:30:5 wt (Tg=39° C.)

I-3: poly(butyl methacrylate-co-Zonyl TA-N®-co-2-acrylamido-2-methylpropanesulfonic acid, sodium salt) 50:45:5 wt (Tg=32° C.)

I-4: poly(ethyl acrylate-co-Zonyl TA-N®-co-2-acrylamido-2-methylpropanesulfonic acid, sodium salt) 50:45:5 wt (Tg=−13° C.)

I-5: poly(ethyl acrylate-co-Zonyl TM®-co-2-acrylamido-2-methylpropanesulfonic acid, sodium salt) 50:45:5 wt (Tg=−11° C.)

I-6: poly(ethyl acrylate-co-Zonyl TM®-co-2-acrylamido-2-methylpropanesulfonic acid, sodium salt) 65:30:5 wt (Tg=−11° C.)

I-7: poly(ethyl acrylate-co-Zonyl TM®-co-2-acrylamido-2-methylpropanesulfonic acid, sodium salt) 75:20:5 wt (Tg=−12° C.)

I-8: poly(ethyl acrylate-co-Zonyl TM®-co-2-acrylamido-2-methylpropanesulfonic acid, sodium salt) 85:10:5 wt (Tg=−11° C.)

I-9: poly(n-butyl acrylate-co-Zonyl TA-N®) 80:20, Tg=−43° C.

I-10: poly(n-butyl acrylate-co-Zonyl TA-N®-co-2-acrylamido-2-methylpropane sulfonic acid, sodium salt) 80:15:5, Tg=−44° C.

I-11: poly(n-butyl acrylate-co-Zonyl TM®-co-2-acrylamido-2-methylpropane sulfonic acid, sodium salt) 50:45:5, Tg=−39° C.

I-12: poly(n-butyl methacrylate-co-Zonyl TM®-co-2-acrylamido-2-methylpropane sulfonic acid, sodium salt) 50:45:5, Tg=32° C.

The thickness of the overcoat layer can be between about 0.11 g/m$^2$ and about 1.1 g/m$^2$, preferably between about 0.22 g/m$^2$ and about 0.65 g/m$^2$.

The support for the dye-receiving element of the invention may be transparent or reflective, and may be a polymeric, a synthetic paper, or a cellulosic paper support, or laminates thereof. In a preferred embodiment, a paper support is used. In a further preferred embodiment, a polymeric layer is present between the paper support and the dye image-receiving layer. For example, there may be employed a polyolefin such as polyethylene or polypropylene. In a further preferred embodiment, white pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150; 4,965,238; 4,965,239; and 4,965,241, the disclosures of which are incorporated by reference. The receiver element may also include a backing layer such as those disclosed in U.S. Pat. Nos. 5,011,814 and 5,096,875, the disclosures of which are incorporated by reference.

Dye-donor elements that are used with the dye-receiving element of the invention conventionally comprise a support having thereon a dye-containing layer. Any dye can be used in the dye-donor employed in the invention provided it is transferable to the dye-receiving layer by the action of heat. Especially good results have been obtained with sublimable dyes. Dye donors applicable for use in the present invention are described, e.g., in U.S. Pat. Nos. 4,916,112; 4,927,803 and 5,023,228, the disclosures of which are incorporated by reference.

As noted above, dye-donor elements are used to form a dye transfer image. Such a process comprises imagewise-heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of cyan, magenta and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to the receiving elements of the invention are available commercially. Alternatively, other known sources of energy for thermal dye transfer may be used, such as lasers as described in, for example, GB 2,083,726A.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLES

The following dyes were used in the experimental work:

Cyan Dye 1

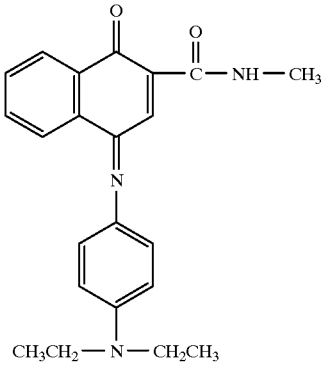

-continued

Cyan Dye 2

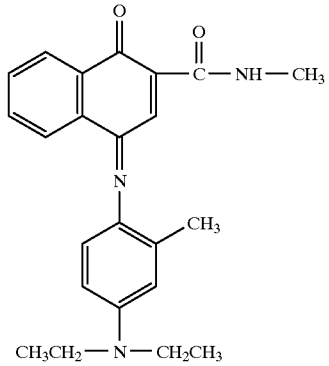

Cyan Dye 3

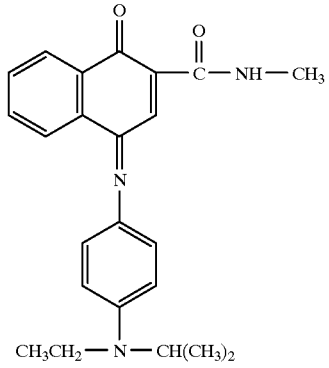

Cyan Dye 4

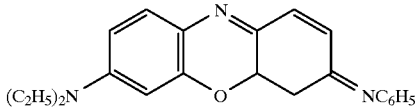

Magenta Dye 1

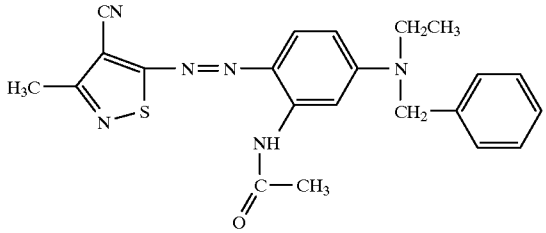

Magenta Dye 2

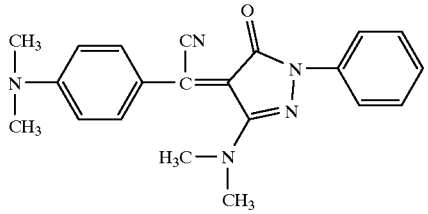

Yellow Dye 1

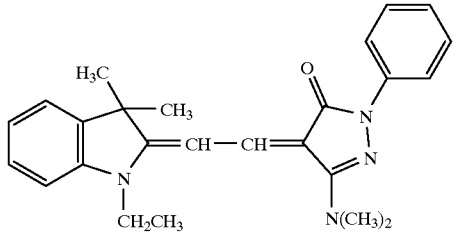

-continued

Yellow Dye 2

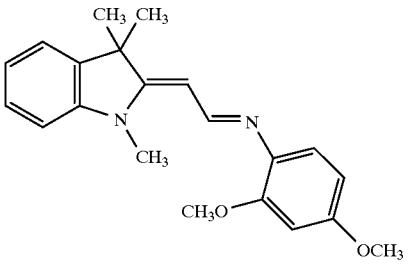

The following control polymers were used as the overcoat layer:

CI-1: FEP-T120, DuPont Chemical Company, similar to the ethylene tetrafluoride/propylene hexafluoride copolymer described in JP2-258,389.

CI-2: Chemslip®42, Chemical Corporation of America, similar to the ethylene tetrafluoride resin described in JP2-258,389.

Example 1

Preparation of Poly(Ethyl Acrylate-co-Zonyl TM®-co-2-Acrylamido-2-Methylpropanesulfonic acid sodium salt) 50:45:5 wt (I-5).

Polymer I-5 was prepared by purging 300 mL water with nitrogen in a three-neck, round-bottom flask equipped with an overhead stir motor and an inlet/addition adapter. Fluorad 143® fluorocarbon surfactant (3M Co.) (2 g) was added to the nitrogen purged flask. This flask was held at 80° C. In a three-necked addition funnel equipped with an overhead stir motor and a nitrogen inlet, 100 mL of water was purged with nitrogen. To the stirring, purged water in the addition flask was added, in this order: Fluorad 143® (2 g), 50 g ethylacrylate, 45.0 g Zonyl TM®, and 10 g 2-acrylamido-2-methylpropanesulfonic acid, sodium salt. Potassium persulfate (1.0 g) and 0.33 g of sodium metabisulfite were added to the reaction flask, and the addition of the monomers was started immediately. The monomer suspension was added to the reaction flask over 45 minutes. At the end of the addition, the reaction was stirred at 80° C. for two hours. After cooling to room temperature, the reaction was adjusted to a pH of 5.5 with 5.5 mL of a 10% wt/wt solution of sodium hydroxide. Tg=−11° C.

Other polymers of the invention can be prepared in a similar manner using the method described above.

Example 2

Control Receiver Element C-1

This element was prepared by first extrusion-laminating a paper core with a 38 μm thick microvoided composite film (OPPalyte® 350TW, Mobil Chemical Co.) as disclosed in U.S. Pat. No. 5,244,861. The composite film side of the resulting laminate was then coated with the following layers in the order recited:

1) a subbing layer of 0.02 g/m$^2$ Polymin P® polyethyleneimine (BASF Corporation) coated from distilled water
2) and a dye-receiving layer composed of a mixture of 3.23 g/m$^2$ of polyester P-1 and 0.022 g/m$^2$ of a fluorocarbon surfactant (Fluorad FC-170C®, 3M Corporation), coated from distilled water.

Receiver Elements E-1 through E-8 of the invention and Control Receiver Elements C-2 through C-3

These were prepared the same as Control Receiver Element C-1, except the dye image receiver layer was overcoated with 0.54 g/m$^2$ of polymers I-1 through I-8, CI-1 and CI-2.

Preparation of Dye Donor Elements

Dye-donor elements were prepared by coating on a 6 μm poly(ethylene terephthalate) support (DuPont Co.):

1) a subbing layer of titanium tetra-n-butoxide (Tyzor TBT®, DuPont Co.) (0.12 g/m$^2$) from a n-propyl acetate/1-butanol (85/15) solvent mixture, and
2) repeating yellow, magenta and cyan dye patches containing the compositions as described below.

The yellow composition contained 0.29 g/m$^2$ of Yellow Dye 1, 0.31 g/m$^2$ of CAP 482-20 (20 s viscosity cellulose acetate propionate, Eastman Chemical Co.), 0.076 g/m$^2$ of CAP 482-0.5 (0.5 s viscosity cellulose acetate propionate, Eastman Chemical Co.), 0.006 g/m$^2$ of 2 μm divinylbenzene crosslinked beads (Eastman Kodak Co.), and 0.0014 g/m$^2$ of Fluorad FC-430® (3M Corporation) from a toluene/methanol/cylcopentanone solvent mixture (70/25/5).

The magenta composition contained 0.17 g/m$^2$ of Magenta Dye 1, 0.18 g/m$^2$ of Magenta Dye 2, 0.31 g/m$^2$ of CAP 482-20, 0.07 g/m$^2$ of 2,4,6-trimethylanilide of phenylindan-diacid, 0.006 g/m$^2$ of 2 μm divinylbenzene crosslinked beads and 0.0011 g/m$^2$ of Fluorad FC-430® from a toluene/methanol/cylcopentanone solvent mixture (70/25/5).

The cyan composition contained 0.14 g/m$^2$ of Cyan Dye 1, 0.12 g/m$^2$ of Cyan Dye 2, 0.29 g/m$^2$ of Cyan Dye 3, 0.31 g/m$^2$ of CAP 482-20, 0.02 g/m$^2$ of CAP 482-0.5, 0.01 g/m$^2$ of 2 μm divinylbenzene crosslinked beads and 0.0007 g/m$^2$ of Fluorad FC-430® from a toluene/methanol/cylcopentanone solvent mixture (70/25/5).

On the backside of the donor element were coated the following layers in sequence:

1) a subbing layer of titanium tetra-n-butoxide (Tyzor TBT®, DuPont Co.) (0.12 g/m$^2$) from a n-propyl acetate/1-butanol (85/15) solvent mixture, and
2) a slipping layer containing 0.38 g/m$^2$ poly(vinyl acetal) (Sekisui Co.), 0.022 g/m$^2$ Candelillia wax dispersion (7% in methanol), 0.011 g/m$^2$ PS513 aminopropyldimethyl-terminated polydimethylsiloxane (Huels) and 0.003 g/m$^2$ p-toluenesulfonic acid coated from 3-pentanone (98%)/distilled water (2%) solvent mixture.

Preparation and Evaluation of Thermal Dye Transfer Images

Eleven-step sensitometric full color (yellow+magenta+cyan) thermal dye transfer images were prepared from the above dye-donor and dye-receiver elements. The dye side of the dye-donor element, approximately 10 cm×15 cm in area, was placed in contact with a receiving-layer side of a dye-receiving element of the same area. This assemblage was clamped to a stepper motor-driven, 60 mm diameter rubber roller. A thermal head (TDK No. 8F10980, thermostatted at 25° C.) was pressed with a force of 24.4 Newton (2.5 kg) against the dye-donor element side of the assemblage, pushing, it against the rubber roller.

The imaging electronics were activated causing the donor-receiver assemblage to be drawn through the printing head/roller nip at 40.3 mm/sec. Coincidentally, the resistive elements in the thermal print head were pulsed for 127.75 μs/pulse at 130.75 μs intervals during a 4.575 ms/dot printing cycle (including a 0.391 ms/dot cool down interval). A stepped image density was generated by incrementally increasing the number of pulses/dot from a minimum of 0 to a maximum of 32 pulses/dot. The voltage supplied to the thermal head was approximately 14.0 v resulting in an instantaneous peak power of 0.369 watts/dot and a maximum total energy of 1.51 mJ/dot; print room humidity: 50–57% RH.

The above printing procedure was done using the yellow, magenta and cyan dye-donor patches. When properly registered, a full color image was obtained. During the printing process, the level of donor-to-receiver sticking was determined visually and rank ordered. A 0 indicates no donor-receiver sticking was observed, a 3 indicates medium levels of sticking and a 5 indicates severe sticking.

To protect the surface of the receiver from typical environmental conditions such as fingerprints, a final lamination layer is transferred to the surface of the receiver, after the dye donor patches have been transferred.

The laminate composition contained 0.45 g/m$^2$ of poly (vinyl acetal) (Sekisui Co.), 0.086 g/m$^2$ of divinyl benzene crosslinked beads (Eastman Kodak Co.), and 0.011 g/m$^2$ of a microgel of poly(isobutyl methacrylate-co-2-ethylhexyl methacrylate-co-divinyl benzene)67:30:3 wt coated from diethylketone, as disclosed in U.S. Pat. No. 5,387,573.

The laminate support material is pressed against the receiver material in the same printing fixture previously used to transfer the dye donor patches to the receiver. The printhead is energized with the same voltage previously used for printing the dyes. The resistive elements are pulsed 32 times for 118.0 microseconds/pulse at 130.75 microsecond intervals. Thus, the lamination energy is 1.39 milliJoules/dot. After the printing process, lamination quality (how well the laminate adhered to the receiver) was determined visually and rank ordered. A 0 indicates acceptable lamination, a 1 indicates marginally acceptable lamination, and a 2 indicates unacceptable lamination (laminate did not stick to layer, gave blotchy appearance).

In addition, dye uptake for each laminated print was determined by measuring the optical densities for yellow, magenta and cyan channels at Dmax (step 11) using a X-Rite 820® Densitometer. The results are summarized in the following table:

TABLE 1

| Element | Overcoat | Stick Ranking | Lamination Quality | Yellow Dmax | Magenta Dmax | Cyan Dmax |
|---|---|---|---|---|---|---|
| E-1 | I-1 | 0 | 0 | 1.9 | 1.8 | 1.9 |
| E-2 | I-2 | 0 | 0 | 1.9 | 1.7 | 1.7 |
| E-3 | I-3 | 0 | 0 | 1.9 | 1.8 | 1.9 |
| E-4 | I-4 | 1 | 0 | 2.0 | 2.2 | 2.2 |
| E-5 | I-5 | 0 | 0 | 2.0 | 2.1 | 2.1 |
| E-6 | I-6 | 2 | 0 | 2.0 | 2.2 | 2.0 |
| E-7 | I-7 | 3 | 0 | 2.0 | 2.3 | 2.4 |
| E-8 | I-8 | 3 | 0 | 2.1 | 2.4 | 2.4 |
| C-1* | none | 5 | — | — | — | — |
| C-2 | CI-1 | 0 | 2 | 1.2 | 1.0 | 1.1 |
| C-3** | CI-2 | 2 | 0 | 1.1 | 1.2 | 1.3 |

*donor-receiver sticking severe, OD's could not be measured
**print quality poor-image mottled in appearance The above results show that use of acrylate-containing polymers having at least 10%/wt of a fluorine containing monomer in the overcoat layer (E-1 through E-8) significantly reduced the amount of donor-to-receiver sticking relative to the control receiver element coating that did not have an overcoat layer (C-1). The laminate quality for the overcoat layers of this invention (E-1 through E-8) was significantly better than the ethylene tetrafluoride/propylene hexafluoride copolymer overcoat layer described in control C-2. Although donor-to-receiver sticking and lamination quality for the ethylene tetrafluoride resin overcoat layer described in control C-3 was comparable to or better than what was obtained for E-6 through E-8, print quality was poor and dye uptake (see Dmax values in Table 1) was significantly lower than what was obtained for receiver elements (E-6 through E-8) of the invention.

Example 3

Control Receiver Elements C-4 through C-6

These elements were prepared as described for Control Receiver Element C-1 in Example 2, except polymers P-2 through P-4 were used in place of P-1.

Receiver Elements E-9 Through E-11

These elements were prepared as described for Receiver Elements E-1 through E-8 in Example 2, except polymers P-2 through P-4 were used in place of polymer P-1 and 0.54 g/m$^2$ of I-5 was used as the overcoat layer.

Thermal dye transfer prints were prepared using Receiver Elements E-9 through E-11 and Control Receiver Elements C-4 through C-6 and evaluated as described in Example 1 except the prints were not laminated after the 3 dye donor patches (yellow+magenta+cyan) were transferred to the receiver. The results for donor-to-receiver sticking and dye uptake are summarized in the following table:

TABLE 2

| Element | Polymer | Stick Ranking | Yellow Dmax | Magenta Dmax | Cyan Dmax |
|---|---|---|---|---|---|
| E-9 | P-2 | 0 | 1.9 | 2.0 | 1.9 |
| E-10 | P-3 | 0 | 2.0 | 2.2 | 2.1 |
| E-11 | P-4 | 0 | 2.0 | 2.0 | 2.0 |
| C-4* | P-2 | 4 | — | — | — |
| C-5* | P-3 | 3 | — | — | — |
| C-6* | P-4 | 4 | — | — | — |

*donor-receiver sticking was severe and OD of dyes could not be measured.

The above results show that use of fluorine-containing acrylate polymers in the overcoat layer for receiver elements containing a variety of polyester polymers in the undercoat layer (E-9 through E-11) significantly reduced the amount of donor-to-receiver sticking relative to the control receiver elements that did not have an overcoat layer (C-4 through C-6). In addition, acceptable dye uptake was achieved for all receiver elements containing a fluorine derived acrylate polymer in the overcoat layer (E-9 through E-11).

Example 4

Control Receiver Element C-7

This element was prepared as described for Control Receiver Element C-1 in Example 1, except the subbing layer was a mixture of Prosil® 221 (aminopropyl triethoxysilane) and Prosil® 2210 (an aminofunctional epoxysilane) (0.05 g/m$^2$ each), (both available from PCR, Inc.) coated from 3A alcohol and the dye receiving layer was composed of a mixture of 2.42 g/m$^2$ of the sulfonic acid of Eastman AQ 29D® polyester, P-5 (Eastman Chemicals), 0.10 g/m$^2$succinic acid, and 3.53 g/m$^2$of Polymer A, coated from distilled water.

Receiver Elements E-12 Through E-15 and Control Receivers C-8 and C-9

Receiver elements E-12 through E-15 were prepared the same as C-7 except the dye receiving layer was overcoated with 0.22 g/m$^2$ of flourine-containing acrylate, polymers I-9 through I-12, respectively. Control Receiver Elements C-8 and C-9 were also prepared the same as C-7 except the dye-receiving layer was overcoated with 0.22 g/m$^2$ of polymers CI-1 and CI-2, respectively.

Cyan Dye Donor Element 2

Cyan Dye Donor Element 2 was prepared as described in Example 2 except the dye side contained 0.15 g/m$^2$ of Cyan Dye 4, 0.18 g/m$^2$ of bisphenol A epichlorohydrin copolymer (phenoxy resin from Scientific Polymer Products) and 0.05 g/m$^2$ of poly(butyl methacrylate-co-Zonyl TM®) 75:25 wt., coated from a tetrahydrofuran and cyclopentanone mixture (95/5) with no surfactant.

Preparation and Evaluation of Thermal Dye Transfer Images

A uniform 9.4 cm×11.7 cm cyan patch image (ca. OD=2.0) was made in a thermal printing device described in Example 2 using Cyan Dye Donor Element 2 and Control Receiver Elements C-7 through C-9 and Receiver Elements E-12 through E-15. The resistive elements in the thermal print head were pulsed for 128 ms/pulse in a 4.8 ms/line printing cycle. The voltage supplied to the thermal head was approximately 13.5 v resulting in an instantaneous peak power of 0.366 watts/dot and a maximum total energy of 1.50 mJ/dot. The initial thermal print head temperature is set at 25° C. Print room temperature and humidity was 21° C. and 50% RH, respectively.

During the cyan patch printing process, the degree of donor-to-receiver sticking was qualitatively evaluated using the rating described above in Example 2.

Also, the cyan dye uptake was determined by measuring the reflective optical density (OD) of the cyan patch image using a X-Rite 820® Densitometer. The optical density shown in Table 4 is an average of five readings within the cyan patch image after the patch image was incubated at 50° C. for 16 hours. The results are summarized in the following table:

TABLE 3

| Receiver Element | Overcoat | Stick Ranking | Dye Uptake of Cyan Dye 4 |
|---|---|---|---|
| E-12 | I-9 | 3 | 2.88 |
| E-13 | I-10 | 3 | 2.87 |
| E-14 | I-11 | 3 | 2.88 |
| E-15 | I-12 | 0 | 2.61 |
| C-7 | none | 5 | —* |
| C-8 | CI-1 | 2 | 2.28 |
| C-9 | CI-2 | 4 | 1.97 |

*dye uptake could not be measured due to severe donor-receiver sticking and obvious dye pick-off.

The above results show that the use of fluorine-containing acrylate copolymers as overcoats in the Receiver Elements (E-12 through E-15) reduces the donor-to-receiver sticking significantly as compared to that of the Control Receiver Element which does not have an overcoat (C-7). Although Control Receiver Elements C-8 and C-9 also show improvement in donor-to-receiver sticking relative to C-7, the dye uptake for C-8 and C-9 was much less than the dye uptake obtained for E-12 through E-15.

The invention has been described in detail with particular reference to preferred embodiments thereof, but it will be understood that variations and modifications can be effected within the spirit and scope of the invention.

What is claimed is:

1. A dye-receiving element for thermal dye transfer comprising a support having on one side thereof a dye image-receiving layer comprising a water-dispersible polyester having the following structure:

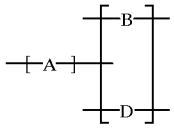

wherein:

A is the residue of one or more diol components which together comprise 100 mole % of recurring units and is represented by the following structure:

$$—O—(CHR^2CHR^3O)_m—R^1—(OCHR^2CHR^3)_n—O—$$

wherein:

$R^1$ represents S, an alkylene group of 1 to about 16 carbon atoms; a cycloalkylene group of 5 to about 20 carbon atoms; a cyclobisalkylene group of about 8 to about 20 carbon atoms, a bi- or tri-cycloalkylene group of about 7 to about 16 carbon atoms, a bi- or tri-cyclobisalkylene group of about 9 to about 18 carbon atoms, an arenebisalkylene group of from 8 to about 20 carbon atoms or an arylene group of 6 to about 12 carbon atoms;

$R^2$ and $R^3$ each independently represents H, a substituted or unsubstituted alkyl group of about 1 to about 6 carbon atoms or a substituted or unsubstituted aryl group of about 6 to about 12 carbon atoms; and m and n each independently represents an integer from 0–4;

B is the residue of a diacid component which comprises about 8 to 50 mole % of recurring units and is represented by one or more of the following structures:

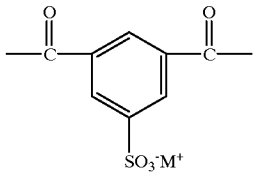

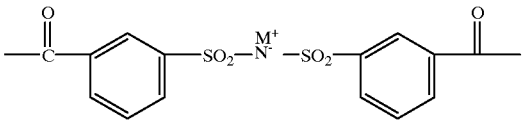

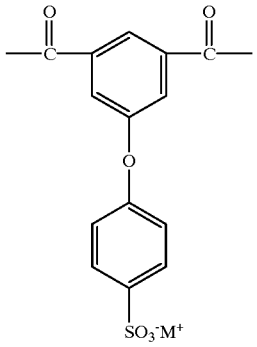

-continued

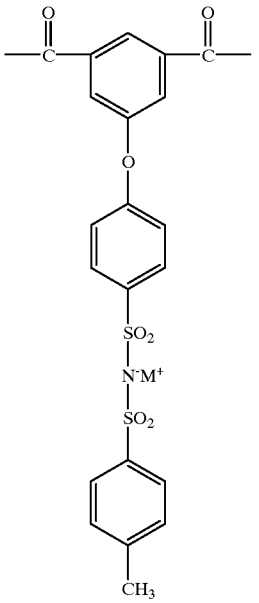

wherein $M^+$ represents either the sodium salt or the sulfonic acid or the protonated form of a basic, nitrogen containing moiety having a pKa measured in water of from about 6 to about 10; and D is the residue of a diacid component which comprises 50 to 92 mole % of recurring units and is represented by one or more of the following structures:

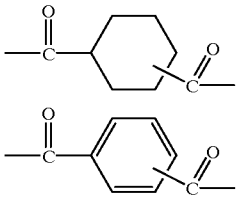

or

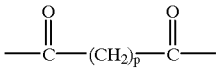

where p represents an integer from 2 to 10;

said dye image-receiving layer having an overcoat layer comprising a fluorine-containing acrylate polymer.

2. The element of claim 1 wherein said fluorine-containing acrylate polymer is a vinyl ester having the following general formula:

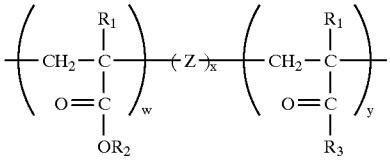

wherein:

$R_1$ is hydrogen or methyl;

$R_2$ is a substituted or unsubstituted alkyl group of 1 to about 16 carbon atoms; a cycloalkylene group of 5 to about 20 carbon atoms; or a substituted or unsubstituted aryl group of 1 to about 6 carbon atoms;

$R_3$ is a water solubilizing monomer;

Z is a repeat unit derived from acrylate or methacrylate esters of a fluorinated alcohol $HOCH_2CH_2(CF_2)_n—CF_3$ where n is between 3 and 17;

w represents a number that yields from 90 to 50 weight percent of the polymer;

x represents a number that yields from 50 to 10 weight percent of the polymer; and y represents a number that yields from 0 to 10 weight percent of the polymer.

3. The element of claim 2 wherein Z contains at least one of the following monomers:

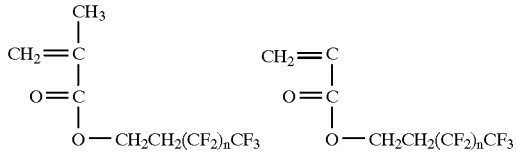

where n is about 3 to about 17.

4. The element of claim 3 wherein said monomer is present between about 10 and 90 wt. %.

5. The element of claim 1 wherein the thickness of the overcoat layer is between about 0.11 $g/m^2$ and about 1.1 $g/m^2$.

6. A process of forming a dye transfer image comprising imagewise-heating a dye-donor element comprising a support having thereon a dye layer and transferring a dye image to a dye-receiving element to form said dye transfer image, said dye-receiving element comprising a support having thereon a dye image-receiving layer comprising a water-dispersible polyester having the following structure:

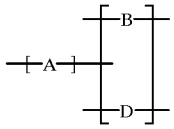

wherein:

A is the residue of one or more diol components which together comprise 100 mole % of recurring units and is represented by the following structure:

$$—O—(CHR^2CHR^3O)_m—R^1—(OCHR^2CHR^3)_n—O—$$

wherein:

$R^1$ represents S, an alkylene group of 1 to about 16 carbon atoms; a cycloalkylene group of 5 to about 20 carbon atoms; a cyclobisalkylene group of about 8 to about 20 carbon atoms, a bi- or tri-cycloalkylene group of about 7 to about 16 carbon atoms, a bi- or tri-cyclobisalkylene group of about 9 to about 18 carbon atoms, an arenebisalkylene group of from 8 to about 20 carbon atoms or an arylene group of 6 to about 12 carbon atoms;

$R^2$ and $R^3$ each independently represents H, a substituted or unsubstituted alkyl group of about 1 to about 6 carbon atoms or a substituted or unsubstituted aryl group of about 6 to about 12 carbon atoms; and m and n each independently represents an integer from 0–4;

B is the residue of a diacid component which comprises about 8 to 50 mole % of recurring units and is represented by one or more of the following structures:

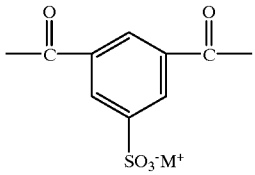

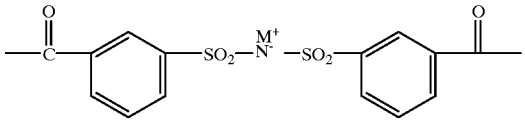

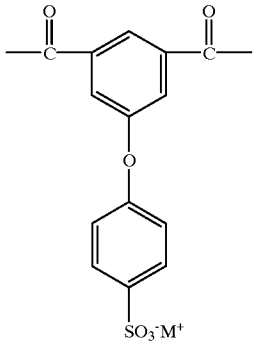

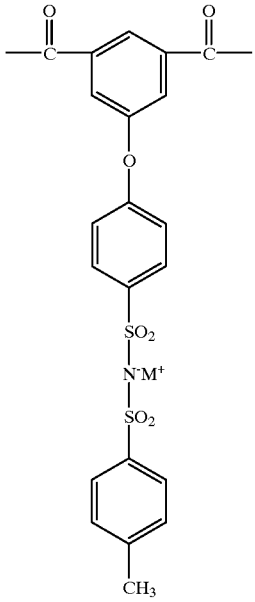

wherein $M^+$ represents either the sodium salt or the sulfonic acid or the protonated form of a basic, nitrogen containing moiety having a pKa measured in water of from about 6 to about 10; and D is the residue of a diacid component which comprises 50 to 92 mole % of recurring units and is represented by one or more of the following structures:

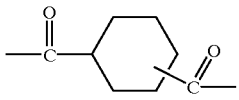

-continued

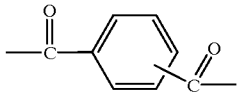

or

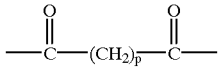

where p represents an integer from 2 to 10;

said dye image-receiving layer having an overcoat layer comprising a fluorine-containing acrylate polymer.

7. The process of claim 6 wherein said fluorine-containing acrylate polymer is a vinyl ester having the following general formula:

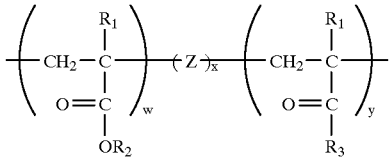

wherein:

$R_1$ is hydrogen or methyl;

$R_2$ is a substituted or unsubstituted alkyl group of 1 to about 16 carbon atoms; a cycloalkylene group of 5 to about 20 carbon atoms; or a substituted or unsubstituted aryl group of 1 to about 6 carbon atoms;

$R_3$ is a water solubilizing monomer;

Z is a repeat unit derived from acrylate or methacrylate esters of a fluorinated alcohol $HOCH_2CH_2(CF_2)_n—CF_3$ where n is between 3 and 17;

w represents a number that yields from 90 to 50 weight percent of the polymer;

x represents a number that yields from 50 to 10 weight percent of the polymer; and y represents a number that yields from 0 to 10 weight percent of the polymer.

8. The process of claim 7 wherein Z contains at least one of the following monomers:

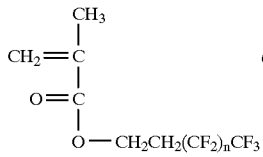

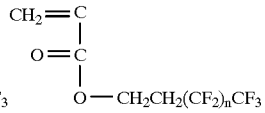

where n is about 3 to about 17.

9. The process of claim 8 wherein said monomer is present between about 10 and 90 wt. %.

10. The process of claim 6 wherein the thickness of the overcoat layer is between about 0.11 $g/m^2$ and about 1.1 $g/m^2$.

11. A thermal dye transfer assemblage comprising: (a) a dye-donor element comprising a support having thereon a dye layer, and (b) a dye-receiving element comprising a support having thereon a dye image-receiving layer, said dye-receiving element being in a superposed relationship with said dye-donor element so that said dye layer is in contact with said dye image-receiving layer; wherein said dye image-receiving layer comprises a water-dispersible polyester having the following structure:

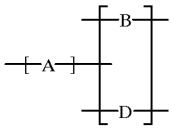

wherein:

A is the residue of one or more diol components which together comprise 100 mole % of recurring units and is represented by the following structure:

$$—O—(CHR^2CHR^3O)_m—R^1—(OCHR^2CHR^3)_n—O—$$

wherein:

$R^1$ represents S, an alkylene group of 1 to about 16 carbon atoms; a cycloalkylene group of 5 to about 20 carbon atoms; a cyclobisalkylene group of about 8 to about 20 carbon atoms, a bi- or tri-cycloalkylene group of about 7 to about 16 carbon atoms, a bi- or tri-cyclobisalkylene group of about 9 to about 18 carbon atoms, an arenebisalkylene group of from 8 to about 20 carbon atoms or an arylene group of 6 to about 12 carbon atoms;

$R^2$ and $R^3$ each independently represents H, a substituted or unsubstituted alkyl group of about 1 to about 6 carbon atoms or a substituted or unsubstituted aryl group of about 6 to about 12 carbon atoms; and m and n each independently represents an integer from 0–4;

B is the residue of a diacid component which comprises about 8 to 50 mole % to of recurring units and is represented by one or more of the following structures:

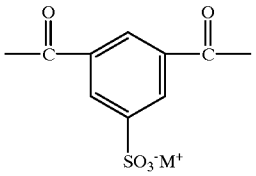

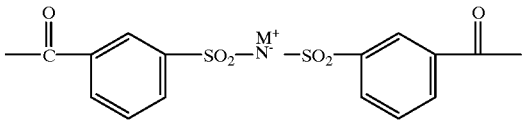

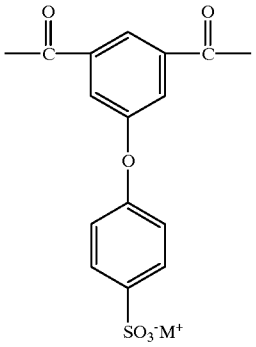

-continued

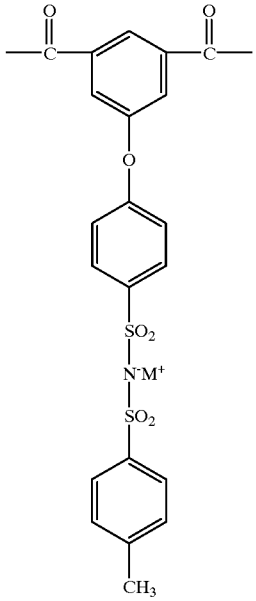

wherein $M^+$represents either the sodium salt or the sulfonic acid or the protonated form of a basic, nitrogen containing moiety having a pKa measured in water of from about 6 to about 10; and D is the residue of a diacid component which comprises 50 to 92 mole % of recurring units and is represented by one or more of the following structures:

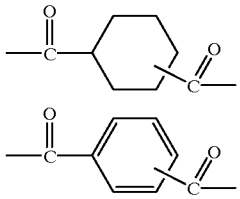

or

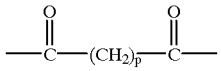

where p represents an integer from 2 to 10;

said dye image-receiving layer having an overcoat layer comprising a fluorine-containing acrylate polymer.

12. The assemblage of claim 11 wherein said fluorine-containing acrylate polymer is a vinyl ester having the following general formula:

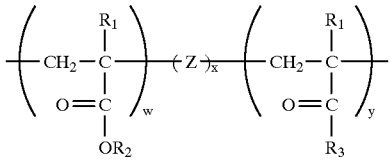

wherein:

$R_1$ is hydrogen or methyl;

$R_2$ is a substituted or unsubstituted alkyl group of 1 to about 16 carbon atoms; a cycloalkylene group of 5 to about 20 carbon atoms; or a substituted or unsubstituted aryl group of 1 to about 6 carbon atoms;

$R_3$ is a water solubilizing monomer;

Z is a repeat unit derived from acrylate or methacrylate esters of a fluorinated alcohol $HOCH_2CH_2(CF_2)_n—CF_3$ where n is between 3 and 17;

w represents a number that yields from 90 to 50 weight percent of the polymer;

x represents a number that yields from 50 to 10 weight percent of the polymer; and y represents a number that yields from 0 to 10 weight percent of the polymer.

13. The assemblage of claim 12 wherein Z contains at least one of the following monomers:

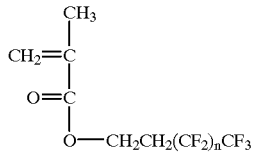

-continued

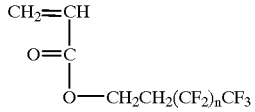

where n is about 3 to about 17.

14. The assemblage of claim 13 said monomer is present between about 10 and 90 wt. %.

15. The assemblage of claim 11 wherein the thickness of the overcoat layer is between about 0.11 $g/m^2$ and about 1.1 $g/m^2$.

* * * * *